US012569058B1

(12) United States Patent
Zhang

(10) Patent No.: US 12,569,058 B1
(45) Date of Patent: Mar. 10, 2026

(54) FOLDING TABLE

(71) Applicant: Xinggang Zhang, Changzhou (CN)

(72) Inventor: Xinggang Zhang, Changzhou (CN)

( * ) Notice: Subject to any disclaimer, the term of this patent is extended or adjusted under 35 U.S.C. 154(b) by 0 days.

(21) Appl. No.: 19/314,285

(22) Filed: Aug. 29, 2025

(30) Foreign Application Priority Data

Oct. 29, 2024 (CN) ..... 202422625842.8

(51) Int. Cl.
*A47B 3/08* (2006.01)
*A47B 9/10* (2006.01)
*A47B 13/02* (2006.01)
*A47B 13/08* (2006.01)

(52) U.S. Cl.
CPC ..... *A47B 3/0818* (2013.01); *A47B 9/10* (2013.01); *A47B 13/023* (2013.01); *A47B 13/081* (2013.01); *A47B 2013/024* (2013.01)

(58) Field of Classification Search
CPC . A47B 2200/0042; A47B 3/0818; A47B 9/10; A47B 13/023; A47B 13/081; A47B 2013/024
USPC ..... 108/7, 10
See application file for complete search history.

(56) References Cited

U.S. PATENT DOCUMENTS 1,726,786 A * 9/1929 Whitney ..... A47F 5/12 211/171
2,050,638 A * 8/1936 Roy ..... A47F 5/12 108/150
2,567,593 A * 9/1951 Bemis ..... A47F 3/14 211/171
3,640,228 A * 2/1972 Busse ..... A47B 23/046 108/6
3,669,392 A * 6/1972 Saunders ..... A47G 29/00 248/316.4
3,715,995 A * 2/1973 Thomas ..... A47B 23/046 248/423
5,243,921 A * 9/1993 Kruse ..... A47B 9/00 248/408
6,132,018 A * 10/2000 McGrath ..... A47F 3/007 248/398
6,578,500 B2 * 6/2003 Malizia ..... A47C 4/08 108/115
6,578,501 B1 * 6/2003 Moore ..... A47B 9/10 108/147
6,694,891 B1 * 2/2004 Lai ..... A47B 19/08 248/150
8,726,814 B1 * 5/2014 Matteo ..... A47B 9/16 248/292.12
11,779,107 B1 * 10/2023 Hernandez ..... A47B 13/081 108/2
12,059,070 B2 * 8/2024 Lu ..... A47B 3/002
12,383,819 B1 * 8/2025 Tian ..... A47B 37/00
2003/0094123 A1 * 5/2003 Ulmer ..... A47B 13/023 108/10

(Continued)

*Primary Examiner* — Jose V Chen
(74) *Attorney, Agent, or Firm* — HOWARD M COHN and Associates, LLC

(57) ABSTRACT

A folding table is provided. The folding table includes a base assembly, a vertical support, and a tabletop. The vertical support is rotatably connected to the base assembly, and base assembly rotates with respect to the vertical support to fold relative to the vertical support. The tabletop is rotatably connected to the vertical support, and the tabletop rotates with respect to the vertical support to fold relative to the vertical support. The folding table facilitates compact storage.

18 Claims, 8 Drawing Sheets

(56) References Cited

U.S. PATENT DOCUMENTS

| | | | | |
|---|---|---|---|---|
| 2007/0095257 | A1* | 5/2007 | Hernandez | A47B 3/0815 108/115 |
| 2008/0041683 | A1* | 2/2008 | Dorquez | A45C 9/00 190/11 |
| 2018/0125233 | A1* | 5/2018 | Leier | A47B 13/088 |
| 2020/0240575 | A1* | 7/2020 | Lee | F16M 13/022 |
| 2020/0305594 | A1* | 10/2020 | Lin | A47B 9/14 |
| 2021/0068531 | A1* | 3/2021 | Tao | A47B 13/003 |
| 2021/0267361 | A1* | 9/2021 | Leng | A47B 19/06 |
| 2023/0086318 | A1* | 3/2023 | Moore | A47B 5/04 108/50.02 |
| 2023/0160118 | A1* | 5/2023 | Ryu | D05B 75/06 112/217.1 |
| 2023/0240440 | A1* | 8/2023 | Leng | A47B 3/002 108/132 |

* cited by examiner

FOLDING TABLE

TECHNICAL FIELD

The present disclosure relates to a technical field of furniture, and in particular to a folding table.

BACKGROUND

Folding furniture is a type of furniture designed to minimize an occupied area or volume through folding. The folding furniture breaks through conventional design paradigms of furniture, and upon careful consideration, reveals a unique aesthetic appeal. Combining pragmatism with flexible and versatile usage, the folding furniture offers diverse functionalities, which not only saves significant space in living areas but also eliminates constraints of compact living. Conventional tabletops are mostly fixed in structure, occupying a large area and making storage inconvenient when not in use.

SUMMARY

Embodiments of the present disclosure provide a folding table.

The folding table includes a base assembly, a vertical support, and a tabletop. The vertical support is rotatably connected to the base assembly, and base assembly rotates with respect to the vertical support to fold relative to the vertical support. The tabletop is rotatably connected to the vertical support, and the tabletop rotates with respect to the vertical support to fold relative to the vertical support.

Furthermore, the base assembly includes a base plate and at least one vertical plate. The base plate is configured to be placed on a supporting surface, and the vertical support is spaced from the base plate. The at least one vertical plate is fixedly connected to one side of the base plate facing the vertical support, the vertical support is rotatably connected to the at least one vertical plate, such that the base plate rotates with respect to the vertical support and folds relative to vertical support.

Furthermore, the base assembly includes two vertical plates, and the two vertical plates are spaced apart from each other. The vertical support is rotatably disposed between the two vertical plates. At least one of the two vertical plates defines a first limiting hole, and the vertical support defines a second limiting hole corresponding to the first limiting hole. The base assembly further includes at least one limiting portion, the at least one limiting portion passes through the first limiting hole and the second limiting hole to lock the vertical support and the base assembly relative to each other.

Furthermore, at least one of the first limiting hole and the second limiting hole is threadedly connected to the at least one limiting portion.

Furthermore, the base assembly further includes a connecting component, and the connecting component is rotatably connected between the two vertical plates. The vertical support is fixedly connected to the connecting component.

Furthermore, the base assembly further includes a limiting plate, and the limiting plate is disposed at one side of the vertical support facing away from the connecting component. The limiting plate is connected between the two vertical plates to limit a rotation direction of the vertical support.

Furthermore, when the base assembly is unfolded relative to the vertical support, each of the two vertical plates includes a protruding portion protruding beyond the vertical support along a radial direction of the vertical support. The base assembly further includes a rotating shaft, and the rotating shaft is disposed between two protruding portions of the two vertical plates. The connecting component is connected to the rotating shaft, such that the connecting component rotates with respect to the two vertical plates.

Furthermore, the connecting component includes a main body portion and two extending portions, the main body portion is fixedly connected to the vertical support, and the two extending portions extend toward the vertical support from the main body portion and are respectively disposed at two opposite sides of the vertical support.

Furthermore, the connecting component further includes a bottom portion, and the bottom portion is connected to the main body portion. When the base assembly is unfolded relative to the vertical support, the bottom portion of the connecting component is disposed between the vertical support and the base plate.

Furthermore, the bottom portion of the connecting component is partially disposed opposite to the vertical support. The bottom portion of the connecting component is fixedly connected to the vertical support by at least one fastener.

Furthermore, the base plate includes a connecting portion and two supporting portions, the connecting portion is connected to the two vertical plates, and the two supporting portions are respectively disposed at two opposite sides of the connecting portion along a length direction of the connecting portion.

Furthermore, ends of the two supporting portions are disposed at the same side of the connecting portion along a width direction. When the base assembly is folded relative to the vertical support, one end of the connecting component away from the tabletop and the ends of the two supporting portions are configured to collectively support the folding table.

Furthermore, the one end of the connecting component away from the tabletop and the ends of the two supporting portions are coplanar.

Furthermore, a first protective pad is disposed at the one end of the connecting component away from the tabletop.

Furthermore, a roller is disposed at at least one of two ends of a bottom side of each of the two supporting portions.

Furthermore, the folding table further includes a rotating mechanism, the tabletop is connected to the vertical support via the rotating mechanism, and the rotating mechanism includes an angle adjuster and a first driving portion. The first driving portion is connected to the angle adjuster, the tabletop is connected to the vertical support via the angle adjuster, and the first driving portion is configured to drive the angle adjuster to switch between a locked state and an unlocked state. When the angle adjuster is in the unlocked state, the tabletop rotates with respect to the vertical support; and when the angle adjuster is in the locked state, the tabletop is locked with respect to the vertical support.

Furthermore, the first driving portion is disposed at one side of the tabletop facing the base assembly.

Furthermore, the vertical support includes an inner rod and an outer rod, the outer rod is telescopically disposed over the inner rod, and the outer rod is axially movable relative to the inner rod to adjust a distance between the tabletop and the base assembly.

Furthermore, the vertical support further includes an air spring mechanism and a second driving portion, and the second driving portion is configured to drive the air spring mechanism to switch between an adjustable state and a fixed state. When the air spring mechanism is in the adjustable state, the tabletop is vertically adjusted relative to the base assembly; and when the air spring mechanism is in the fixed state, the tabletop maintains a fixed height relative to the base assembly.

Furthermore, the second driving portion is disposed at the one side of the tabletop facing the base assembly.

In the embodiments of the present disclosure, the folding table includes the base assembly, the vertical support, and the tabletop. The tabletop is configured to place objects or serves as a work surface. The vertical support is connected between the base assembly and the tabletop. The tabletop rotates with respect to the vertical support to achieve primary folding, i.e., folding the tabletop relative to the vertical support. The base assembly rotates with respect to the vertical support to achieve secondary folding, i.e., folding the base assembly relative to the vertical support. Compared to tables that are non-foldable or foldable only once, the folding table of the present disclosure adopts a two-stage folding design to achieve a significantly reduced volume after folding, which occupies minimal area or space, in this way, easy storage is facilitated and the folding table of the present disclosure is allowed to be conveniently placed into narrow storage spaces.

BRIEF DESCRIPTION OF DRAWINGS

In order to more clearly illustrate technical solutions in embodiments of the present disclosure, accompanying drawings required in description of the embodiments are briefly described below, and obviously, the accompanying drawings in the following description are merely some embodiments of the present disclosure, and for those who skilled in the art, other drawings may be obtained according to structures shown in these drawings without creative efforts.

For a more complete understanding of the present disclosure and corresponding beneficial effects, following description is made with reference to the accompanying drawings, in which the same reference numerals refer to the same parts.

Figure 1:
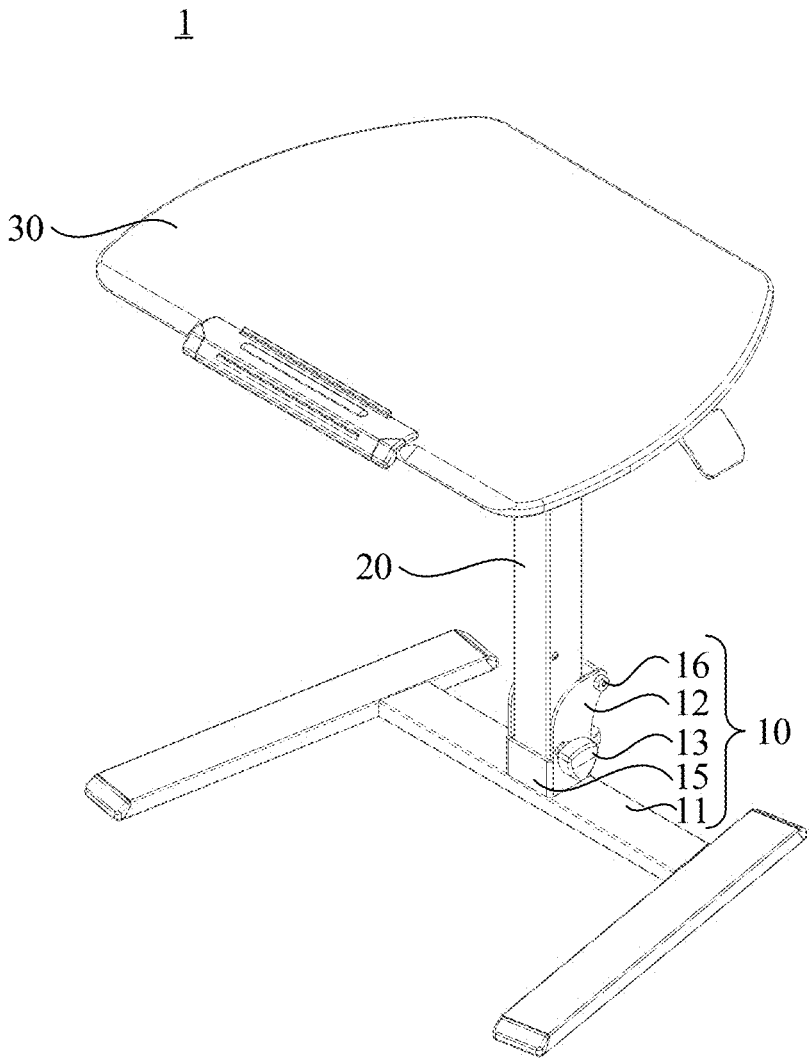
FIG. 1 is a structural schematic diagram of a folding table in an unfolded configuration according to one embodiment of the present disclosure.

Reference numerals in the drawings: 1. folding table; 10. base assembly; 11. base plate; 112. connecting portion; 114. supporting portion; 116. roller; 12. vertical plate; 121. first limiting hole; 122. protruding portion; 13. at least one limiting portion; 14. connecting component; 142. main body portion; 144. extending portion; 146. bottom portion; 148. first protective pad; 15. limiting plate; 16. rotating shaft; 20. vertical support; 21. second limiting hole; 22. inner rod; 24. outer rod; 26. air spring mechanism; 28. second driving portion; 30. tabletop; 40. rotating mechanism; 42. angle adjuster; 44. first driving portion.

DETAILED DESCRIPTION OF EMBODIMENTS

The following clearly and completely describes technical solutions in embodiments of the present disclosure with reference to accompanying drawings in the embodiments of the present disclosure. Obviously, described embodiments are only a part but not all of the embodiments of the present disclosure. The following description of at least one exemplary embodiment is merely illustrative in nature and is in no way intended to limit the present disclosure, corresponding applications, or corresponding uses. All other embodiments obtained by those who skilled in the art based on the embodiments of the present disclosure without creative efforts shall fall within a protection scope of the present disclosure.

As used herein, a term "embodiment" means that a particular feature, structure, or characteristic described in connection with an embodiment may be included in at least one embodiment of the present disclosure. Appearance of the term "embodiment" in various locations throughout the specification does not necessarily refer to the same embodiment, nor does it imply that the embodiments of the present disclosure are mutually exclusive, independent, or alternative to one another. Those who skilled in the art may readily appreciate, both explicitly and implicitly, that the embodiments described herein may be combined with other embodiments.

Figure 2:
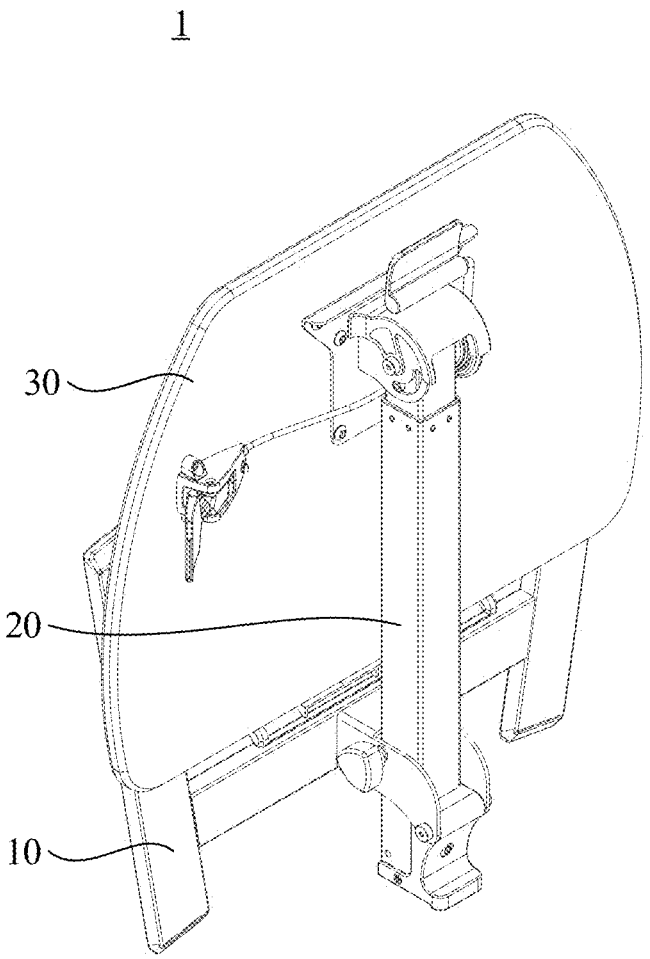
FIG. 2 is a structural schematic diagram of the folding table shown in FIG. 1, illustrating the folding table in a folded configuration.

Please refer to FIGS. 1-2, FIG. 1 is a structural schematic diagram of a folding table 1 in an unfolded configuration according to one embodiment of the present disclosure, and FIG. 2 is a structural schematic diagram of the folding table 1 shown in FIG. 1, illustrating the folding table 1 in a folded configuration. The embodiments of the present disclosure provide the folding table 1, including a base assembly 10, a vertical support 20, and a tabletop 30. The vertical support 20 is rotatably connected to the base assembly 10, and base assembly 10 rotates with respect to the vertical support 20 to fold relative to the vertical support 20. The tabletop 30 is rotatably connected to the vertical support 20, and the tabletop 30 rotates with respect to the vertical support 20 to fold relative to the vertical support 20.

Specifically, the vertical support 20 is connected between the base assembly 10 and the tabletop 30. The tabletop 30 rotates with respect to the vertical support 20 to achieve primary folding, i.e., folding the tabletop 30 relative to the vertical support 20. The base assembly 10 rotates with respect to the vertical support 20 to achieve secondary folding, i.e., folding the base assembly 10 relative to the vertical support 20. Compared to tables that are non-foldable or foldable only once, the folding table 1 of the present disclosure adopts a two-stage folding design to achieve a significantly reduced volume after folding, which occupies minimal area or space. In this way, easy storage is facilitated and the folding table 1 of the present disclosure is allowed to be conveniently placed into narrow storage spaces, such as vehicle trunks, balcony corners, or cabinets. Moreover, the folding table 1 of the present disclosure is capable of flexibly switching between a usage state (achieved when in the unfolded configuration) and a storage state (achieved when in the folded configuration) based on user requirements. When in use, the folding table 1 is rapidly unfolded, with the tabletop 30 configured to place objects or serve as a work surface to meet daily needs. In space-constrained environments, the folding table 1 is stored via two-stage folding, thereby minimizing occupied space and enhancing usability.

Figure 3:
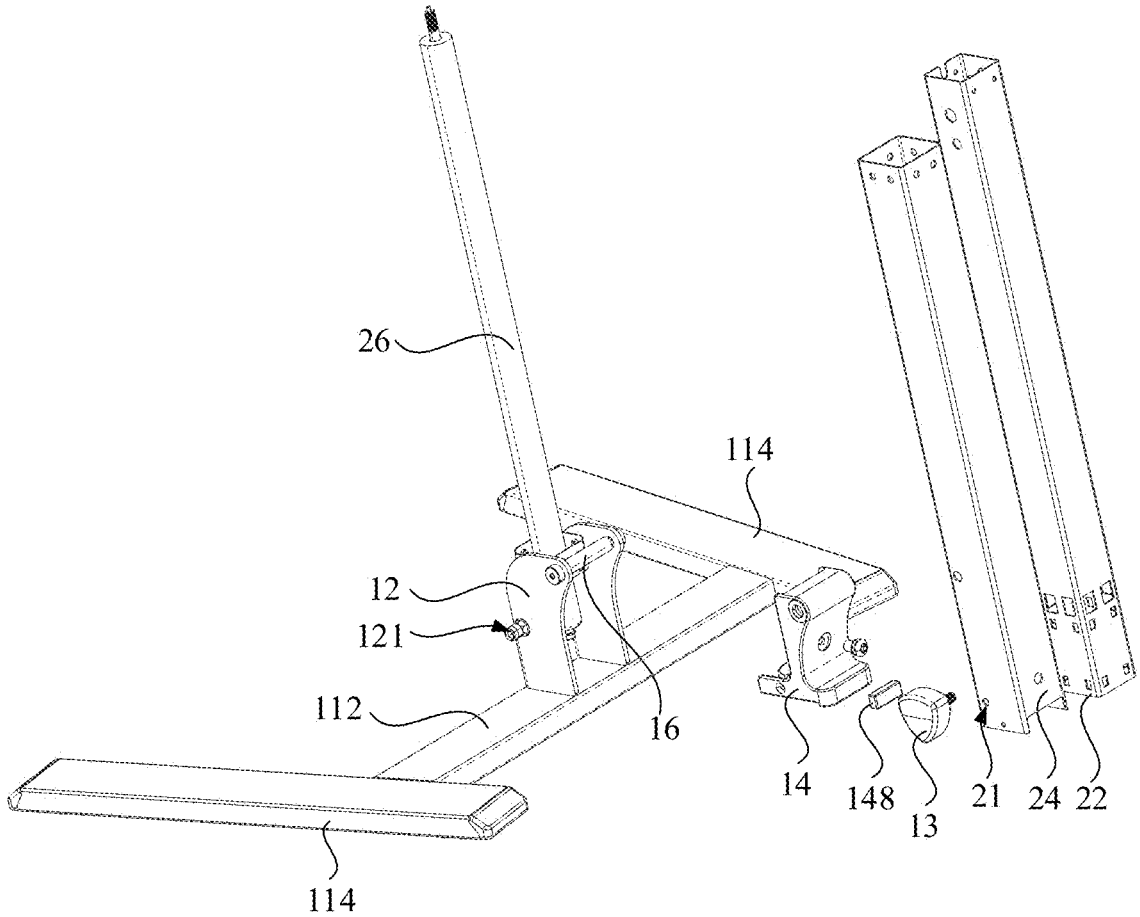
FIG. 3 is an exploded structural schematic diagram of partial structures of the folding table shown in FIG. 1.

Please refer to FIG. 3, FIG. 3 is an exploded structural schematic diagram of partial structures of the folding table 1 shown in FIG. 1. In some embodiments, the base assembly 10 includes a base plate 11 and at least one vertical plate 12. The base plate 11 is configured to be placed on a supporting surface, and the vertical support 20 is spaced from the base plate 11. The at least one vertical plate 12 is fixedly connected to one side of the base plate 11 facing the vertical support 20, the vertical support 20 is rotatably connected to the at least one vertical plate 12, such that the base plate 11 rotates with respect to the vertical support 20 and folds relative to vertical support 20.

In the embodiment, the vertical support 20 is rotatably connected to the base plate 11 via the at least one vertical plate 12, so as to facilitate connection between the base assembly 10 and the vertical support 20. Moreover, the vertical support 20 is spaced from the base plate 11, when the vertical support 20 rotates with respect to the base plate 11, sufficient clearance is provided for rotation, preventing interference between components and ensuring smooth relative rotation between the base assembly 10 and the vertical support 20.

It should be understood that, to enhance connection strength and stability, the base assembly 10 include two vertical plates 12, the vertical support 20 is disposed between the two vertical plates 12 and rotatably connected to the two vertical plates 12. In other embodiments, to simplify a structure of the folding table 1, the base assembly 1 include a single vertical plate 12, and the vertical support 20 is directly rotatably connected to the single vertical plate 12.

Figure 4:
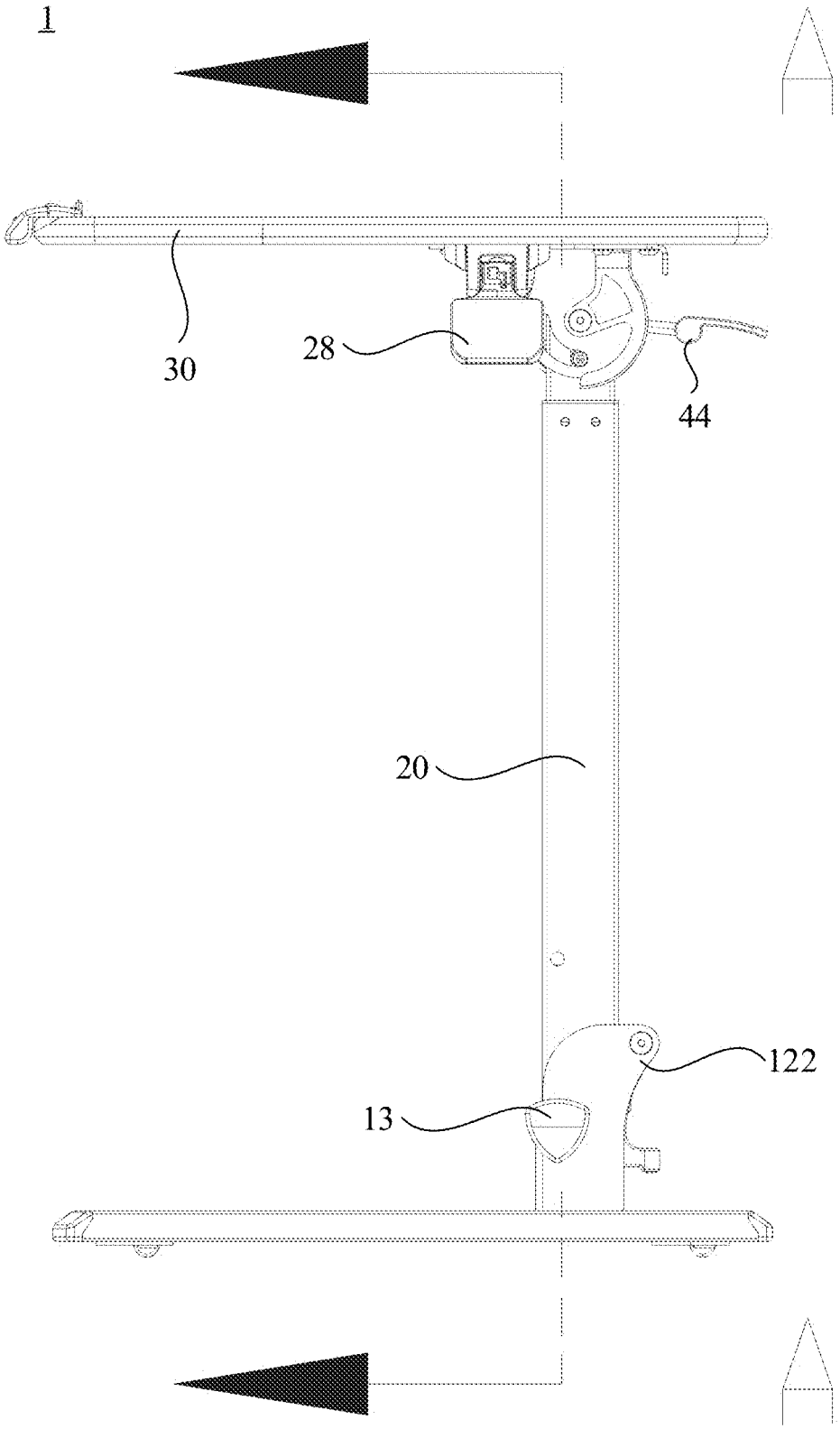
FIG. 4 is another structural schematic diagram of the folding table shown in FIG. 1.
Figure 5:
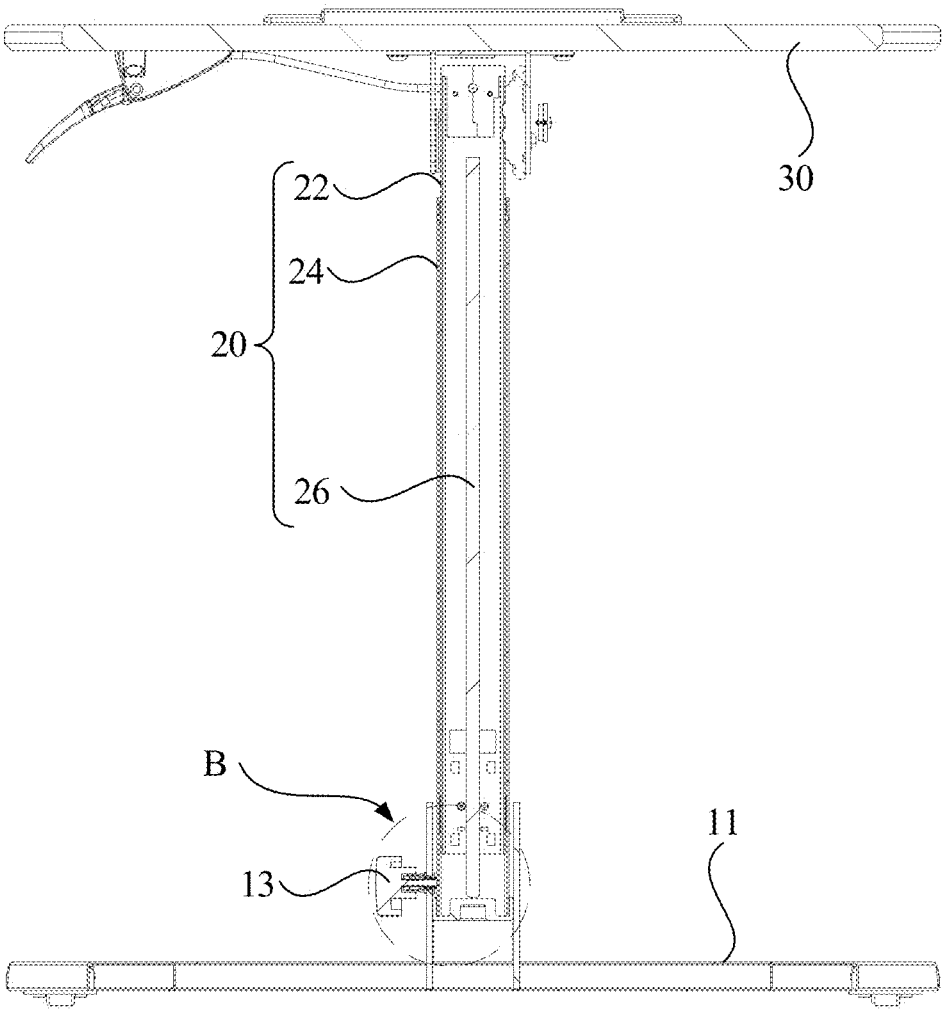
FIG. 5 is a cross-sectional schematic diagram of the folding table taken along the line A-A shown in FIG. 4.
Figure 6:
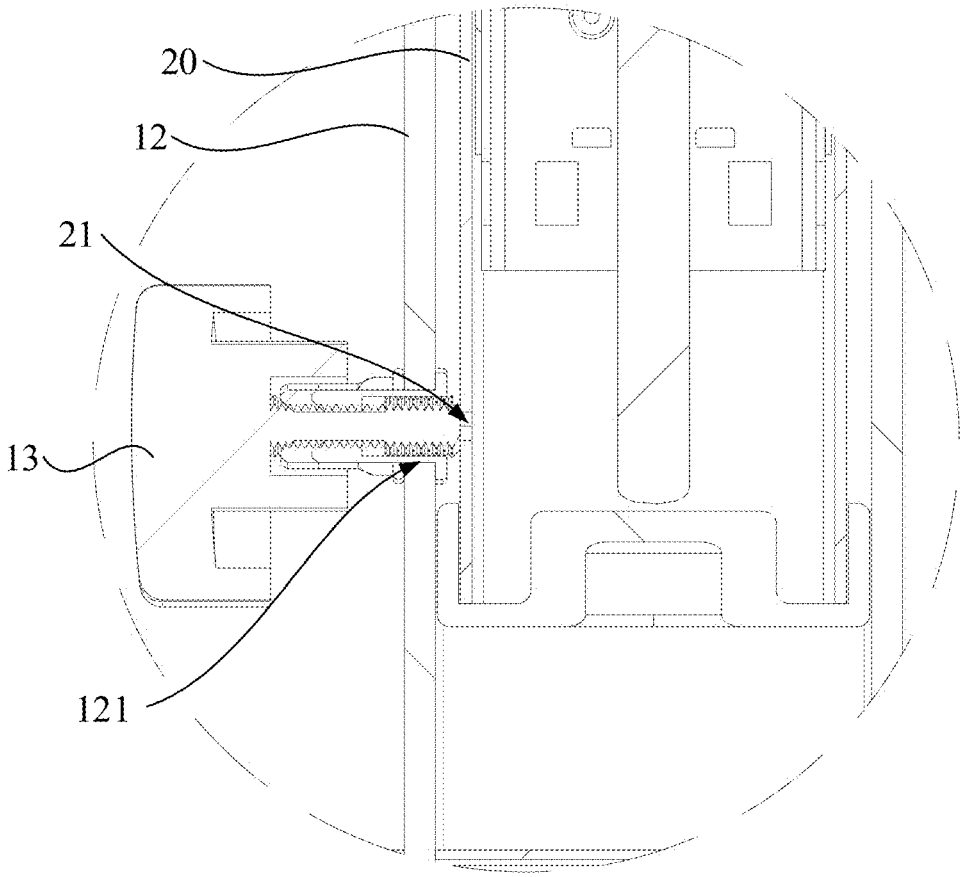
FIG. 6 is an enlarged schematic diagram of portion B shown in FIG. 5.

Please further refer to FIGS. 4-6, FIG. 4 is another structural schematic diagram of the folding table 1 shown in FIG. 1, FIG. 5 is a cross-sectional schematic diagram of the folding table 1 taken along the line A-A shown in FIG. 4, and FIG. 6 is an enlarged schematic diagram of portion B shown in FIG. 5. In some embodiments, the base assembly 10 includes the two vertical plates 12, and the two vertical plates 12 are spaced apart from each other. The vertical support 20 is rotatably disposed between the two vertical plates 12. At least one of the two vertical plates 12 defines a first limiting hole 121, and the vertical support 20 defines a second limiting hole 21 corresponding to the first limiting hole 121. The base assembly 10 further includes at least one limiting portion 13, the at least one limiting portion 13 passes through the first limiting hole 121 and the second limiting hole 21 to lock the vertical support 20 and the base assembly 10 relative to each other.

In the embodiment, the at least one limiting portion 13 is configured to limit a relative position between the vertical support 20 and the base assembly 10. For example, when the folding table 1 is in the unfolded configuration, the at least one limiting portion 13 passes through the first limiting hole 121 of the at least one of the two vertical plates 12 and the second limiting hole 21 of the vertical support 20 to securely lock the vertical support 20 and the at least one of the two vertical plates 12 10 relative to each other, which effectively prevents unintended rotation of the vertical support 20 during use, thereby enhancing the reliability and stability of the unfolded configuration of the folding table 1 and providing users with a robust and reliable working platform.

It should be understood that, in one embodiment, one of the two vertical plates 12 is locked to the vertical support by one limiting portion 13; alternatively, in other embodiments, two limiting portions 13 are provided to respectively lock the two vertical plates 12 to the vertical support 20 on both sides.

In some embodiments, at least one of the first limiting hole 121 and the second limiting hole 21 is threadedly connected to the at least one limiting portion 13.

In the embodiment, threaded connection ensures that the at least one limiting portion 13 is securely fixed between the first limiting hole 121 and the second limiting hole 21. Internal threads are disposed on an inner wall of at least one of the first limiting hole 121 and the second limiting hole 21. The limiting portion 13 is threadedly connected to the first limiting hole 121 (i.e., the first limiting hole 121 is a threaded hole), or to the second limiting hole 21 (i.e., the second limiting hole 21 is a threaded hole), or to both (i.e., both the first limiting hole 121 and the second limiting hole 21 are threaded holes). Thus, in the embodiment, the limiting portion 13 is not simply inserted into the first limiting hole 121 and the second limiting hole 21 but is tightly engaged and fixed by threaded connection within at least one of the second limiting hole 21 and the first limiting hole 121, preventing wobbling of the vertical support 20 relative to the base assembly 10.

In some embodiments, a structure, such as a washer, is disposed between the at least one limiting portion 13 and the at least one vertical plate 12. Certainly, in other embodiments, no washer is provided between the at least one limiting portion 13 and the at least one vertical plate 12. To enhance connection stability and reduce wear, a buffer structure, such as the washer, is disposed between the at least one limiting portion 13 and the at least one vertical plate 12, thereby forming a protective layer therebetween. Such arrangement minimizes direct friction between the at least one limiting portion 13 and the at least one vertical plate 12 and reduces wear caused by prolonged use.

In some embodiments, the at least one limiting portion 13 includes a head portion and a shaft portion. The shaft portion passes through the first limiting hole 121 and the second limiting hole 21. The head portion has a larger dimension than the shaft portion, preventing its passage through the first limiting hole 121 and the second limiting hole 21. Such configuration ensures that the at least one limiting portion 13 remains securely fixed in a correct position, preventing accidental disengagement that leads to unintended movement between the vertical support 20 and the base assembly 10. Furthermore, the larger dimension of the head portion facilitates easier gripping and application of force by the users during operation, thereby improving usability.

In some examples, a material of the head portion differs from a material of the shaft portion. For example, the shaft portion is made of metal to ensure strength and durability, while the head portion is made of plastic to reduce weight and improve tactile comfort. Alternatively, in other examples, the head portion and the shaft portion are made of the same material, such as metal, to ensure uniformity and durability of the at least one limiting portion 13.

In some embodiments, the base assembly 10 further includes a connecting component 14, and the connecting component 14 is rotatably connected between the two vertical plates 12. The vertical support 20 is fixedly connected to the connecting component 14.

In the embodiment, the connecting component 14 is disposed on inner sides of the two vertical plates 12, enabling the connecting component 14 itself to perform rotational movement relative to the two vertical plates 12. The vertical support 20 is securely fixed to the connecting component 14, for example, by means of bolt fastening, snap-fit engagement, or welding. Consequently, the vertical support 20 is rotatably connected to the two vertical plates 12 via the connecting component 14. Since the vertical support 20 itself no longer needs to provide a direct rotational connection function, a specific structure thereof is simplified, in this way, manufacturing of the vertical support 20 is facilitated, strength of the vertical support 20 is ensured, and a cost of the vertical support 20 is reduced. Furthermore, the connecting component 14 is disposed on the inner sides of the two vertical plates 12, while an operating area for locking the vertical support 20 and at least one of the two vertical plates 12 with the at least one limiting portion 13 is located on an outer side of the at least one of the two vertical plates 12. Thus, the connecting component 14 does not interfere with the at least on limiting portion 13. Locking between the vertical support 20 and the at least one of the two vertical plates 12, and fixing between the vertical support 20 and the connecting component 14, have minimal or no mutual influence, thereby facilitating user operation.

In some embodiments, the base assembly 10 further includes a limiting plate 15, and the limiting plate 15 is disposed at a first side of the vertical support 20 facing away from the connecting component 14. The limiting plate 15 is connected between the two vertical plates 12 to limit a rotation direction of the vertical support 20.

In the embodiment, a rotation direction of the vertical support 20 is limited by the limiting plate 15. It is understood that due to a relatively high installation position of a rotating shaft 16, during folding rotation, a first portion of the vertical support 20 above the rotating shaft 16 swings through a large angle. The first portion of the vertical support 20 above the rotating shaft 16 does not contact the limiting plate 15 located in front of the vertical support 20 during rotation. Meanwhile, a second portion of the vertical support 20 below the rotating shaft 16 rotates backward during folding and likewise does not contact the limiting plate 15. Therefore, when the users initiate folding, the vertical support 20 rotates forward, i.e., toward the limiting plate 15. Upon rotating approximately 90 degrees, the vertical support 20 abuts against the limiting plate 15. Acting as a physical stop, the limiting plate 15 prevents further forward rotation of the vertical support 20, ensuring a folding motion stops precisely at a predetermined position that is safe, compact, and stable.

If the users attempt to rotate the vertical support 20 backward, i.e., away from the limiting plate 15, the second portion of the vertical support 20 below the rotating shaft 16 contacts the limiting plate 15 located in front thereof, thereby preventing continued rotation in an incorrect direction. Thus, the users do not need to discern a correct folding direction through effort or worry about operational errors, as the limiting plate 15 naturally guides the users to complete a folding action in the correct folding direction. Furthermore, when the folding table 1 is unfolded and in the usage state, if the vertical support 20 tends to rotate backward due to load or external force, the limiting plate 15 provides robust rigid support, effectively resisting such rotational tendency, which enhances restraint and support for the vertical support 20, thereby improving overall structural stability and reliability of the folding table during use.

In some embodiments, when the base assembly 10 is unfolded relative to the vertical support 20, each of the two vertical plates 12 includes a protruding portion 122 protruding beyond the vertical support 20 along a radial direction of the vertical support 20. The base assembly 10 further includes a rotating shaft 16, and the rotating shaft 16 is disposed between two protruding portions 122 of the two vertical plates 12. The connecting component 14 is connected to the rotating shaft 16, such that the connecting component 14 rotates with respect to the two vertical plates 12.

In the embodiment, the two vertical plates 12 extend to respectively form the two protruding portions 122, creating an independent installation space for the rotating shaft 16. The rotating shaft 16 is disposed in the independent installation space, and the connecting component 14 is directly connected to the rotating shaft 16. Such configuration allows the connecting component 14 to drive the vertical support 20 to rotate relative to the two vertical plates 12 about the rotating shaft 16. The rotating shaft 16 is disposed in the independent installation space extended by the two vertical plates 12, avoiding the vertical support 20. The rotating shaft 16 does not penetrate or contact the vertical support 20, maintaining a safe distance with the vertical support 20 and ensuring no structural interference occurs. Such design facilitates smooth rotation of the vertical support 20 about the rotating shaft 16. Furthermore, the two protruding portions 122 are respectively disposed at side surfaces of the vertical support 20 and positioned significantly higher than a bottom end of the vertical support 20. An elevated installation position of the rotating shaft 16 results in the first portion of the vertical support 20 above the rotating shaft 16 forming a longer moment arm, enabling a large-angle rotation.

When the users need to fold the base assembly 10, the vertical support 20 is simply folded toward the base assembly 10. Such action drives a rotation of either the connecting component 14 alone or a combined unit of the connecting component 14 and the rotating shaft 16, ultimately causing the vertical support 20 to stably lie flat on the base assembly 10, thereby completing the secondary folding.

In some examples, the rotating shaft 16 passes through both the connecting component 14 and the two protruding portions 122 of the two vertical plates 12, and is capable of rotating with respect to the connecting component 14 and the two protruding portions 122 of the two vertical plates 12. Since the connecting component 14 is fixedly connected to the vertical support 20, such configuration enables the vertical support 20 to rotate about the rotating shaft 16 via the connecting component 14. Specifically, when the users intend to fold the vertical support 20 toward the base assembly 10, a force applied to the vertical support 20 drives the connecting component 14 fixedly connected thereto. As the connecting component 14 and the rotating shaft 16 cooperatively rotate approximately 90 degrees, the vertical support 20 is driven to tilt and lie flat on the base assembly 10, so as to complete a folding process.

In some embodiments, the connecting component 14 is fixedly connected to the rotating shaft 16. The rotating shaft 16 passes through the two protruding portions 122 of the two vertical plates 12, and is capable of rotating with respect to the two protruding portions 122 of the two vertical plates 12. The connecting component 14 is fixedly connected to the vertical support 20, thereby enabling the vertical support 20 to rotate about the rotating shaft 16 via the connecting component 14. Specifically, when the users fold the vertical support 20 toward the base assembly 10, the force applied to the vertical support 20 simultaneously drives the connecting component 14 and the rotating shaft 16 fixedly connected thereto. Two ends of the rotating shaft 16 rotate approximately 90 degrees between the two protruding portions 122 of the two vertical plates 12, thereby driving the connecting component 14 and the vertical support 20 to rotate together, ultimately causing the vertical support 20 to tilt and lie flat on the base assembly 10 to complete the folding process.

In other embodiments, the two protruding portions 122 of the two vertical plates 12 are fixedly connected to the rotating shaft 16. The rotating shaft 16 passes through the connecting portion 14, and is capable of rotating with respect to the connecting component 14. The connecting portion 14 is fixedly connected to the vertical support 20, thereby enabling the vertical support 20 to rotate about the rotating shaft 16 via the connecting component 14. Specifically, the two ends of the rotating shaft 16 are fixedly connected to the two protruding portions 122 of the two vertical plates 12, so that the rotating shaft 16 itself does not rotate with respect to the two protruding portions 122 of the two vertical plates 12, the rotating shaft 16 passes through the connecting portion 14, and the connecting portion 14 is capable of freely rotating about the rotating shaft 16. When the users fold the vertical support 20, the force applied to the vertical support 20 drives the connecting portion 14 fixedly connected thereto to rotate approximately 90 degrees about the rotating shaft 16, ultimately causing the vertical support 20 to tilt and lie flat on the base assembly 10 to complete the folding process.

Figure 7:
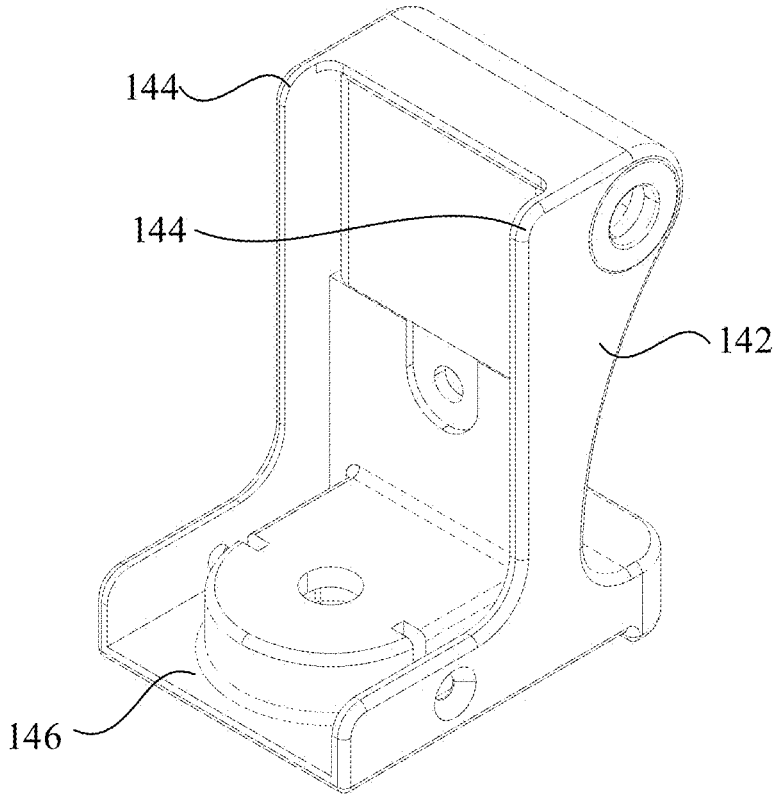
FIG. 7 is a structural schematic diagram of a connecting component of the folding table shown in FIG. 1.

Please refer to FIG. 7, FIG. 7 is a structural schematic diagram of a connecting component 14 of the folding table 1 shown in FIG. 1. The connecting component 14 includes a main body portion 142 and two extending portions 144, the main body portion 142 is fixedly connected to the vertical support 20, and the two extending portions 144 extend toward the vertical support 20 from the main body portion 142 and are respectively disposed at two opposite sides of the vertical support 20.

In the embodiment, the main body portion 142 is disposed on a second side of the vertical support 20, while the two extending portions 144 are disposed at two other opposite sides of the vertical support 20. The connecting component 14 thus engages with the vertical support 20 from three directions, providing multi-directional constraining forces that enable better coordination and positioning with the vertical support 20. In some examples, the main body portion 142 is attached to a rear side of the vertical support 20, and the two extending portions 144 respectively clamp a left side and a right side of the vertical support 20, thereby securely positioning the vertical support 20 on the base assembly 10. Such configuration effectively reduces wobbling of the vertical support 20 during use, consequently enhancing the overall stability of the folding table 1 in the usage state. In some examples, the two extending portions 144 are clamped between the vertical support 20 and the two vertical plates 12, not only efficiently utilizing space but also further reinforcing constraint on the vertical support 20 and reducing movement of the vertical support 20.

In some embodiments, the connecting component 14 further includes a bottom portion 146, and the bottom portion 146 is connected to the main body portion 142. When the base assembly 10 is unfolded relative to the vertical support 20, the bottom portion 146 of the connecting component 14 is disposed between the vertical support 20 and the base plate 11.

In the embodiment, when the base assembly 10 is unfolded relative to the vertical support 20, the bottom portion 146 is disposed in a space between the vertical support 20 and the base plate 11 without interfering with a vertical load-bearing function of the vertical support 20. When the base assembly 10 is folded relative to the vertical support 20, rotation of the connecting component 14 causes the bottom portion 146 to cover the bottom end of the vertical support 20. Such configuration protects an end portion of the vertical support 20 and prevents accidental injury to the users from an exposed bottom end of a conventional folding table, thereby enhancing operational safety during both use and storage of the folding table 1 of the present disclosure. Furthermore, edges of the bottom portion 146 are rounded or smoothed to prevent potential user injury.

In some embodiments, the bottom portion 146 of the connecting component 14 is partially disposed opposite to the vertical support 20. The bottom portion 146 of the connecting component 14 is fixedly connected to the vertical support 20 by at least one fastener.

In the embodiment, in addition to fixed connection between the main body portion 142 and the vertical support 20, the bottom portion 146 is fixedly connected to the vertical support 20, which enhances connection strength between the connecting component 14 and the vertical support 20, improving both connection stability connection and wobbling resistance of connection between the connecting component 14 and the vertical support 20. In some examples, the bottom portion 146 has a certain thickness and is partially disposed in the vertical support 20, so that the bottom portion 146 of the connecting component 14 is partially disposed opposite to the vertical support 20, which is convenient for the at least one fastener to pass through the bottom portion 146 and the vertical support 20 to achieve a fixed connection. The second side of the vertical support 20 facing the main body portion 142 of the connecting component 14 defines a notch, specifically at the bottom end of the vertical support 20, to allow the bottom portion 146 to extend into the vertical support 20 through the notch. In some examples, the bottom portion 146 includes a first protruding edge, the first protruding edge is disposed either inside or outside the vertical support 20. The vertical support 20 is partially disposed opposite to the first protruding edge, which is convenient for the at least one fastener to pass through the first protruding edge of the bottom portion 146 and the vertical support 20 to achieve the fixed connection. In other examples, a lowermost end of the vertical support 20 include a second protruding edge. The bottom portion 146 is partially disposed opposite to the second protruding edge, which is convenient for the at least one fastener to pass through the bottom portion 146 and the second protruding edge of the vertical support 20 to achieve the fixed connection. For example, the at least one fastener is selected from a screw, a bolt, etc.

In some embodiments, the base plate 11 includes a connecting portion 112 and two supporting portions 114, the connecting portion 112 is connected to the two vertical plates 12, and the two supporting portions 114 are respectively disposed at two opposite sides of the connecting portion 112 along a length direction of the connecting portion 112.

In the embodiment, the base plate 11, through the connecting portion 112 and the two supporting portions 114, increases a load-bearing area and more evenly distributes forces, thereby more stably supporting the tabletop 30 and the vertical support 20. Such configuration allows loads transmitted from the tabletop 30 and the vertical support 20 to be more uniformly dispersed, effectively enhancing the overall stability and load-bearing capacity of the folding table 1. For example, the connecting portion 112 is disposed at middle portions of the two supporting portions 114 to achieve symmetrical support, or is offset toward one end of each of the two supporting portions 114 according to design requirements. Additionally, in one embodiment, the two supporting portions 114 are disposed in parallel to provide a regular and stable support profile. Alternatively, in other embodiments, the two supporting portions 114 are inclined relative to each other, for example, a distance between one pair of ends of the two supporting portions 114 is smaller than a distance between the other pair of ends of the two supporting portions 114. That is, first ends of the two supporting portions 114 closer to the connecting portion 112 are spaced closer together, while second ends of the two supporting portions 114 farther from the connecting portion 112 are spaced farther apart, or vice versa. Such an inclined arrangement of the two supporting portions 114 optimizes distribution of supporting points.

Furthermore, a structure of the base plate 11 is not limited to the above forms. For example, the base plate 11 includes more than two supporting portions 114 to further expand a support area. For example, the more than two supporting portions 114 are disposed around the connecting portion 112 with the connecting portion 112 centrally positioned. In another example, the more than two supporting portions 114 are connected to each end of the connecting portion 112, and the more than two supporting portions 114 extend in different directions.

In some embodiments, ends of the two supporting portions 114 are disposed at the same side of the connecting portion 112 along a width direction. When the base assembly 10 is folded relative to the vertical support 20, one end of the connecting component 14 away from the tabletop 30 and the ends of the two supporting portions 114 are configured to collectively support the folding table 1.

In the embodiment, when the base assembly 10 is folded relative to the vertical support 20, the users position the one end of the connecting portion 14 away from the tabletop 30 together with the ends of the two supporting portions 114 on the supporting surface, such as the ground.

In some embodiments, when the base assembly 10 is folded relative to the vertical support 20, the one end of the connecting component 14 away from the tabletop 30 and the ends of the two supporting portions 114 are coplanar, forming a three-point support configuration that enables more stable placement on the supporting surface, such as the ground.

In some embodiments, a first protective pad 148 is disposed at the one end of the connecting component 14 away from the tabletop 30. The first protective pad 148 is configured to buffer against scraping between the connecting component 14 and the supporting surface, thereby protecting surfaces, such as ceramic tiles, wooden floors, or carpets. The first protective pad 148 is made of flexible or elastic materials, including soft silicone, rubber, plastic, thermoplastic, or foam materials, a specific material of which is not limited herein.

It is understood that when the first protective pad 148 is disposed at the one end of the connecting component 14 away from the tabletop 30, the first protective pad 148 and the ends of the two supporting portions 114 are coplanar, forming a three-point support configuration to support the folding table 1.

In some examples, the ends of the two supporting portions 114 are arc-shaped or rounded corners to prevent scraping against other components. Additionally, in some embodiments, the ends of the two supporting portions 114 are coated with second protective pads. The protective pads are made of flexible or elastic materials, including soft silicone, rubber, plastic, thermoplastic, or foam materials, a specific material of which is not limited herein.

Furthermore, the first protective pad 148 and the second protective pads provide certain vibration damping and noise reduction effects. It is understood that when the first protective pad 148 is disposed at the one end of the connecting component 14 and the ends of the two supporting portions 114 are coated with second protective pads, the first protective pad 148 at the one end of the connecting component 14 and the second protective pads coated on the ends of the two supporting portions 114 are coplanar, forming a three-point support configuration to support the folding table 1.

In some embodiments, a roller 116 is disposed at at least one of two ends of a bottom side of each of the two supporting portions 114. Each roller 116 facilitates movement of the folding table 1 when in the unfolded configuration. Specifically, each roller 16 allows the users to move the folding table 1 in the unfolded configuration without needing to remove the objects placed thereon and push the folding table 1 in the unfolded configuration with minimal effort, which is convenient and labor-saving.

Figure 8:
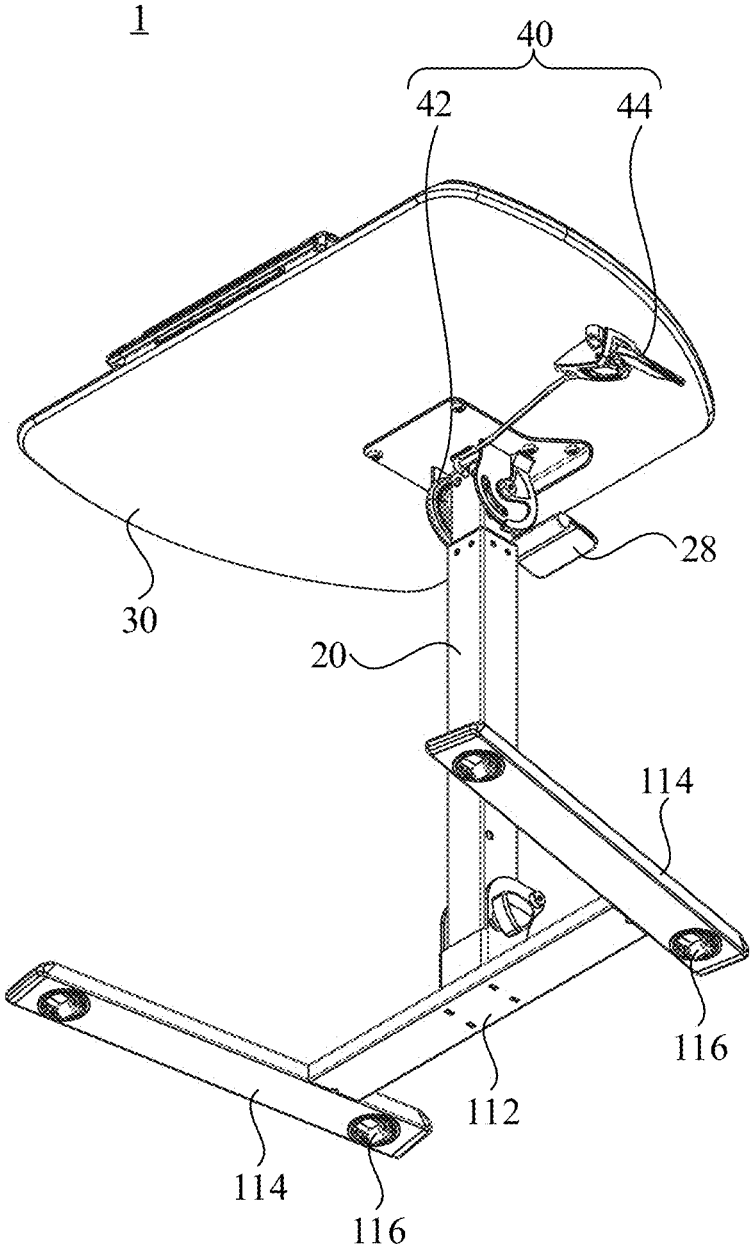
FIG. 8 is another structural schematic diagram of the folding table shown in FIG. 1.

Please refer to FIG. 8, FIG. 8 is another structural schematic diagram of the folding table 1 shown in FIG. 1. The folding table 1 further includes a rotating mechanism 40, the tabletop 30 is connected to the vertical support 20 via the rotating mechanism 40, and the rotating mechanism 40 includes an angle adjuster 42 and a first driving portion 44. The first driving portion 44 is connected to the angle adjuster 42, the tabletop 30 is connected to the vertical support 20 via the angle adjuster 42, and the first driving portion 44 is configured to drive the angle adjuster 42 to switch between a locked state and an unlocked state. When the angle adjuster 42 is in the unlocked state, the tabletop 30 rotates with respect to the vertical support 20; and when the angle adjuster 42 is in the locked state, the tabletop 30 is locked with respect to the vertical support 20.

In the embodiment, the rotating mechanism 40 is configured to connect the tabletop 30 and the vertical support 20, enabling precise control of relative movement between the tabletop 30 and the vertical support 20. The users operate the first driving portion 44, such as a knob, a lever, or a button, to drive the angle adjuster 42 to switch between the locked state and the unlocked state. When the users operate the first driving portion 44, e.g., by loosening or pressing the first driving portion 44, the angle adjuster 42 enters the unlocked state and releases locking constraint on the tabletop 30, allowing the users to adjust a tilt angle of the tabletop 30 relative to the vertical support 20. Conversely, when the users performs a reverse operation, e.g., tightening or releasing the first driving portion 44, the angle adjuster 42 enters the locked state. At this point, a position of the tabletop 30 relative to the vertical support 20 is securely locked, and relative rotation between the tabletop 30 and the vertical support 20 is prevented.

In some embodiments, the angle adjuster 42 is an infinite position angle adjuster 42. When the tilt angle of the tabletop 30 needs to be adjusted, the users operates the first driving portion 44 to place the infinite position angle adjuster 42 in the unlocked state. Once unlocked, the users directly push or pull the tabletop 30 to smoothly adjust a tilt angle of the tabletop 30 relative to the vertical support 20, easily achieving any desired angle of the tabletop 30 suitable for current needs. After the angle of the tabletop 30 is adjusted to a suitable angle, the user operate the first driving portion 44 again to lock the infinite position angle adjuster 42. Upon locking, the infinite position angle adjuster 42 42 immediately securely fixes the tabletop 30, maintaining a current relative position between the tabletop 30 and the vertical support 20. By enabling flexible angular adjustment, the folding table 1 is capable of accommodating various user requirements for different orientations of the tabletop 30 in multiple scenarios. For example, during painting activities, the tabletop 30 is tilted relative to the vertical support 20; when placing the objects, the tabletop 30 is vertically positioned relative to the vertical support 20; and when folding the folding table 1 for storage, the tabletop 30 is made parallel or nearly parallel to the vertical support 20.

The embodiment achieves flexible yet stable angular adjustment of the tabletop 30 relative to the vertical support 20 through integration of the rotating mechanism 40 including the angle adjuster 42 and the first driving portion 44. When the angle adjuster 42 is in the unlocked state, the users easily adjust the tabletop 30 to any desired angle. Once locked, the folding table 1 of the present disclosure provides a stable working surface, seamlessly adapting to various usage scenarios, such as painting and creative work, object placement, reading activities, and storage folding.

In some embodiments, the first driving portion 44 is disposed at one side of the tabletop 30 facing the base assembly 10.

Positioning the first driving portion 44 below the tabletop 30 ensures the first driving portion 44 causes no visual distraction or physical obstruction during normal usage activities, such as writing, painting, or placing computers and other objects on a surface of the tabletop 30. Furthermore, although the first driving portion 44 is disposed below the tabletop 30, the first driving portion 44 remains in a readily accessible area for user operation. When the tilt angle of the tabletop 30 needs to be adjusted, the users simply reach below the tabletop 30 to conveniently, quickly, and directly access and operate the first driving portion 44. In this way, the first driving portion 44 neither interferes with normal usage of the surface of the tabletop 30 nor compromises ability of the users to operate the first driving portion 44 with ease and efficiency.

In some embodiments, the vertical support 20 includes an inner rod 22 and an outer rod 24, the outer rod 24 is telescopically disposed over the inner rod 22, and the outer rod 24 is axially movable relative to the inner rod 22 to adjust a distance between the tabletop 30 and the base assembly 10.

In the embodiment, the outer rod 24 of the vertical support 20 smoothly and stably moves relative to the inner rod 22 along an axial direction of the vertical support 20, flexibly adjusting a height of the tabletop 30, so as to meet various user requirements for the height of the tabletop 30, such as adapting to sitting or standing postures, or accommodating users of different statures. For example, during operation, the users first unlock a height-locking mechanism, then applies upward or downward force to the tabletop 30 or the vertical support 20 to adjust the outer rod 24 along with the tabletop 30 to a desired height. Once the desired height is reached, the users relock the height-locking mechanism to securely fix a relative position of the inner rod 22 and the outer rod 24, ensuring the tabletop 30 remains stable and immobile during use. Such design overcomes limitations of conventional fixed-height tables.

In some embodiments, the vertical support 20 further includes an air spring mechanism 26 and a second driving portion 28, and the second driving portion 28 is configured to drive the air spring mechanism 26 to switch between an adjustable state and a fixed state. When the air spring mechanism 26 is in the adjustable state, the tabletop 30 is vertically adjusted relative to the base assembly 10; and when the air spring mechanism 26 is in the fixed state, the tabletop 30 maintains a fixed height relative to the base assembly 10. The air spring mechanism 26 enables convenient control over vertical movement of the tabletop 30.

In the embodiment, the users operate the second driving portion 28 to switch the air spring mechanism 26 between the adjustable state and the fixed state. When the second driving portion 28 is activated to engage the adjustable state of the air spring mechanism 26, the users apply upward or downward force to the tabletop 30. Pressure-balancing characteristics of the air spring mechanism 26 then provide assistance, allowing the tabletop 30 along with the outer rod 24 of the vertical support 20 to smoothly and effortlessly move relative to the base assembly 10. The users thus adjust the tabletop 30 to an ideal height that matches current needs with minimal effort. Once the tabletop 30 reaches a target height, the users simply releases or reversely operates the second driving portion 28, causing the air spring mechanism 26 to switch to the fixed state. In the fixed state, a height of the tabletop 30 relative to the base assembly 10 is securely maintained, preventing any height deviation even when subjected to tabletop loads or accidental contact. By integrating the air spring mechanism 26 with the second driving portion 28, the present disclosure simplifies a height adjustment process of the tabletop 30, offering both flexibility in adjustment and immediate locking capability, which enhances user comfort and operational efficiency during height adjustment of the tabletop 30.

It should be understood that the vertical support 20 also implements the height adjustment of the tabletop 30 through other means. For example, both the inner rod 22 and the outer rod 24 include locking positions along a height direction thereof, allowing the height adjustment of the tabletop 30 by selecting different locking positions. Alternatively, the vertical support 20 employs a hand crank, a lead screw, and a nut mechanism to achieve the height adjustment of the tabletop 30. As another example, the vertical support 20 employs motor-driven mechanisms, such as electric lead screws, electric belts, or electric rack-and-pinion systems, to accomplish the height adjustment of the tabletop 30.

In some embodiments, the second driving portion 28 is disposed at the one side of the tabletop 30 facing the base assembly 10. Such configuration neither interferes with the normal usage of the surface of the tabletop 30 nor compromises the ability of the users to operate the second driving portion 28 with ease and efficiency.

In some examples, the first driving portion 44 and the second driving portion 28 are disposed at different locations on the tabletop 30. For example, the first driving portion 44 is disposed at a rear side of the tabletop 30, while the second driving portion 28 is disposed at either a left side or a right side of the tabletop 30. Such zoned arrangement prevents the first driving portion 44 and the second driving portion 28 from crowding each other, reduces likelihood of accidental operation, and allows the users to more intuitively and ergonomically locate and control the desired function.

In some embodiments, a stop component is additionally disposed at one side of the tabletop 30. When the users unlock the angle adjuster 42 via the first driving portion 44 and adjusts the tabletop 30 to a suitable tilt angle for painting, writing, or reading, such as for an easel or drafting table, gravity may cause small objects placed on the tabletop 30, such as brushes, pencils, erasers, rulers, or mobile phones, to naturally slide downward. In this scenario, the stop component disposed at a lower edge of the tabletop 30 at the suitable tilt angle serves as a protective barrier, effectively preventing the small objects placed on the tabletop 30 from sliding off the low edge, so as to provide the users with a more secure and efficient working surface.

Optionally, when the stop component is not required, the stop component is capable of retracting into a recess within the tabletop 30, achieving a harmonious balance between functionality and aesthetics.

To clearly illustrate how the folding table 1 transitions between the storage state and the usage state, the following describes operational steps for folding and unfolding the folding table 1 of the present disclosure.

When the users need to fold the folding table 1, the users first perform the primary folding of the tabletop 30 relative to the vertical support 20. The users operates the first driving portion 44 to switch the angle adjuster 42 to the unlocked state. After the angle adjuster 42 is unlocked, the users rotate the tabletop 30 downward toward the vertical support 20. The users continue to rotate the tabletop 30 downward until the tabletop 30 contacts or approaches contact with the vertical support 20, at which point the tabletop 30 is folded against the vertical support 20. Following completion of the primary folding of the tabletop 30, the users subsequently perform the secondary folding of the vertical support 20 and the base assembly 10, specifically, the at least one limiting portion 13 for locking a relative position between the vertical support 20 and the two vertical plates 12 is first removed. For example, if the first limiting hole 121 on at least one of the two vertical plates 12 or the second limiting hole 21 on the vertical support 20 is the threaded hole, and the at least one limiting portion 13 is threadedly engaged, the users need to grasp the head portion of the at least one limiting portion 13 and rotate the head portion of the at least one limiting portion 13 to unscrew the shaft portion of the at least one limiting portion 13 from the second limiting hole 21 on the vertical support 20. After releasing the lock, two common methods are available. In a first method, the users press the vertical support 20 forward toward the base assembly 10. Through the fixed connection with the connecting portion 14 and the rotating shaft 16 connected between the two protruding portions 122 of the two vertical plates 12, the vertical support 20 rotates about the two vertical plates 12. However, if the users attempt to rotate the vertical support 20 backward, the second portion of the vertical support 20 below the rotating shaft 16 immediately contacts the limiting plate 15 and is prevented from moving, thereby avoiding incorrect operation. The users continue to press the vertical support 20 downward until the vertical support 20 rotates approximately 90 degrees, ultimately lying flat and contacting the base plate 11 of the base assembly 10. In a second method, instead of pressing the vertical support 20 downward, the users directly lifts the base plate 11 of the base assembly 10 upward, causing the base plate 11 of the base assembly 10 to rotate toward the vertical support 20. Through the rotating shaft 16 connected between the two protruding portions 122 of the two vertical plates 12 and the connecting component 14 fixedly connected to the vertical support 20, the base assembly 10 rotates relative to the vertical support 20. The user folds the base assembly 10 upward until the base plate 11 of the base assembly 10 also rotates approximately 90 degrees, causing the base plate 11 of the base assembly 10 to contact or approach contact with the vertical support 20. At this point, after the two-stage folding, the folding table 1 assumes a compact, flat folded structure, significantly reducing the occupied space thereof and allowing the users to easily store the folding table in an upright or flat position within space-constrained areas, such as the vehicle trunks, narrow storage cabinet gaps, or the balcony corners.

When the users need to unfold the tabletop 30 for use, the users first grip the base plate 11 of the base assembly 10 and rotate the base plate 11 of the base assembly 10 downward and outward to unfold the base plate 11 of the base assembly 10 relative to the vertical support 20, the base plate 11 of the base assembly 10 moves away from the vertical support 20. Through connection between the two protruding portions 122 of the two vertical plates 12 and the rotating shaft 16, and engagement between the connecting component 14 fixedly connected to the vertical support 20 and the rotating shaft 16, the base assembly 10 begins to rotate about the rotating shaft 16. The users continue to rotate the base assembly 10 downward until the base plate 11 of the base assembly 10 rests flat on the ground. Once the base assembly 10 is stably positioned, the relative position between the vertical support 20 and the base assembly 10 is fixed via the at least one limiting portion 13 to ensure stability during use. For example, the users locate the first limiting hole 121 on at least one of the two vertical plates 12 and the second limiting hole 21 on the vertical support 20, then aligns and inserts the shaft portion of the at least one limiting portion 13 through the first limiting hole 121 and the second limiting hole 21. If either the first limiting hole 121 or the second limiting hole 21 is the threaded hole, rotating the at least one limiting portion 13 causes threads on the shaft portion thereof to tightly engage with the internal threads of the threaded hole, thereby securely locking the two vertical plates 12 with the vertical support 20. In this way, accidental rotation or wobbling of the vertical support 20 is prevented during use. The head portion of the at least one limiting portion 13, being larger than the first limiting hole 121 and the second limiting hole 21, so that the head portion of the at least one limiting portion 13 cannot pass through the first limiting hole 121 and the second limiting hole 21 and it is easy for the users to apply force to rotate the at least one limiting portion 13. If the washer is provided, the washer is compressed between the head portion of the at least one limiting portion 13 and a surface of the vertical plate 12, serving to reduce friction and wear. After the vertical support 20 is securely fixed, the users proceed to unfold the tabletop 30. The users reach below the tabletop 30 on the one side facing the base assembly 10 to locate the first driving portion 44 for controlling tilt angle adjustment of the tabletop 30. Operating the first driving portion 44 drives the angle adjuster 42 connected thereto into the unlocked state. Once unlocked, the users push or pull the tabletop 30 to smoothly rotate the tabletop 30 about the vertical support 20, adjusting the tabletop 30 to a desired tilt angle, for example, horizontal for placing the objects or tilted at a specific angle for painting or reading. When the tabletop 30 is adjusted to the desired tilt angle, the users simply release or reversely operate the first driving portion 44 to drive the angle adjuster 42 back into the locked state, so as to securely fix the tabletop 30 at the desired tilt angle and prevent the tabletop 30 from further rotation relative to the vertical support 20. Additionally, if the users need to adjust the height of the tabletop 30, the users first locate the second driving portion 28 of the vertical support 20 for controlling the height adjustment of the tabletop 30 and the operate the second driving portion 28 to drive the air spring mechanism 26 into the adjustable state. In the adjustable state of the air spring mechanism 26, the users simply apply the upward or downward force to the tabletop 30. Assisted by the air spring mechanism 26, the users effortlessly adjust the height of the tabletop 30 along with the outer rod 24 of the vertical support 20. Specifically, the outer rod 24 is disposed over the inner rod 22 and is axially movable relative to the inner rod 22. When the tabletop 30 reaches the desired height, the users simply release or reversely operate the second driving portion 28, causing the air spring mechanism 26 to switch back to the fixed state, so as to lock a relative position between the outer rod 24 and the inner rod 22, ensuring the tabletop 30 remains stable during use and prevents unintended movement (e.g., unintended lowering or raising) due to applied loads or accidental contact. At this point, the folding table 1 completes a transition from the storage state to the usage state, with the tilt angle and the height of the tabletop 30 personalized according to user requirements.

In the foregoing embodiments, description of each embodiment has its own emphasis, and parts that are not described in detail in an embodiment may refer to related descriptions of other embodiments. The embodiments, implementations, and related technical features of the present disclosure may be combined and replaced with each other without conflict.

The folding table in the embodiments of the present disclosure is described in detail above, and specific examples are used herein to describe principles and the embodiments of the present disclosure, and description of the above embodiments is only used to help understand a method of the present disclosure and a core idea thereof; meanwhile, for those who skilled in the art, according to the idea of the present disclosure, there may be changes in specific embodiments and application ranges. In summary, a content of the present specification should not be construed as limiting the present disclosure.

What is claimed is:

1. A folding table, comprising:

a base assembly;

a vertical support; and a tabletop;

wherein the vertical support is rotatably connected to the base assembly, and the base assembly rotates with respect to the vertical support to fold relative to the vertical support;

wherein the tabletop is rotatably connected to the vertical support, and the tabletop rotates with respect to the vertical support to fold relative to the vertical support;

wherein the base assembly comprises two vertical plates, and the two vertical plates are spaced apart from each other, and the vertical support is rotatably disposed between the two vertical plates;

wherein the base assembly further comprises a connecting component and a limiting plate;

wherein the connecting component is rotatably connected between the two vertical plates and is fixedly connected to the vertical support;

wherein the limiting plate is disposed at one side of the vertical support facing away from the connecting component; and the limiting plate is connected between the two vertical plates to limit a rotation direction of the vertical support.

2. The folding table according to claim 1, wherein the base assembly comprises a base plate;

the base plate is configured to be placed on a supporting surface, and the vertical support is spaced from the base plate; and the base plate rotates with respect to the vertical support and folds relative to the vertical support.

3. The folding table according to claim 2, wherein;

at least one of the two vertical plates defines a first limiting hole, and the vertical support defines a second limiting hole corresponding to the first limiting hole; and the base assembly further comprises at least one limiting portion, the at least one limiting portion passes through the first limiting hole and the second limiting hole to lock the vertical support and the base assembly relative to each other.

4. The folding table according to claim 3, wherein at least one of the first limiting hole and the second limiting hole is threadedly connected to the at least one limiting portion.

5. The folding table according to claim 3, wherein when the base assembly is unfolded relative to the vertical support, each of the two vertical plates comprises a protruding portion protruding beyond the vertical support along a radial direction of the vertical support;

the base assembly further comprises a rotating shaft, and the rotating shaft is disposed between two protruding portions of the two vertical plates; and the connecting component is connected to the rotating shaft, such that the connecting component rotates with respect to the two vertical plates.

6. The folding table according to claim 5, wherein the connecting component comprises a main body portion and two extending portions, the main body portion is fixedly connected to the vertical support, and the two extending portions extend toward the vertical support from the main body portion and are respectively disposed at two opposite sides of the vertical support.

7. The folding table according to claim 6, wherein the connecting component further comprises a bottom portion, and the bottom portion is connected to the main body portion; and when the base assembly is unfolded relative to the vertical support, the bottom portion of the connecting component is disposed between the vertical support and the base plate.

8. The folding table according to claim 7, wherein the bottom portion of the connecting component is partially disposed opposite to the vertical support; and the bottom portion of the connecting component is fixedly connected to the vertical support by at least one fastener.

9. The folding table according to claim 3, wherein the base plate comprises a connecting portion and two supporting portions, the connecting portion is connected to the two vertical plates, and the two supporting portions are respectively disposed at two opposite sides of the connecting portion along a length direction of the connecting portion.

10. The folding table according to claim 9, wherein ends of the two supporting portions are disposed at the same side of the connecting portion along a width direction; and when the base assembly is folded relative to the vertical support, one end of the connecting component away from the tabletop and the ends of the two supporting portions are configured to collectively support the folding table.

11. The folding table according to claim 10, wherein the one end of the connecting component away from the tabletop and the ends of the two supporting portions are coplanar.

12. The folding table according to claim 11, wherein a first protective pad is disposed at the one end of the connecting component away from the tabletop.

13. The folding table according to claim 9, wherein a roller is disposed at at least one of two ends of a bottom side of each of the two supporting portions.

14. The folding table according to claim 1, wherein the folding table further comprises a rotating mechanism, the tabletop is connected to the vertical support via the rotating mechanism, and the rotating mechanism comprises an angle adjuster and a first driving portion;

the first driving portion is connected to the angle adjuster, the tabletop is connected to the vertical support via the angle adjuster, and the first driving portion is configured to drive the angle adjuster to switch between a locked state and an unlocked state;

when the angle adjuster is in the unlocked state, the tabletop rotates with respect to the vertical support; and when the angle adjuster is in the locked state, the tabletop is locked with respect to the vertical support.

15. The folding table according to claim 14, wherein the first driving portion is disposed at one side of the tabletop facing the base assembly.

16. The folding table according to claim 1, wherein the vertical support comprises an inner rod and an outer rod, the outer rod is telescopically disposed over the inner rod, and the outer rod is axially movable relative to the inner rod to adjust a distance between the tabletop and the base assembly.

17. The folding table according to claim 16, wherein the vertical support further comprises an air spring mechanism and a second driving portion, and the second driving portion is configured to drive the air spring mechanism to switch between an adjustable state and a fixed state;

when the air spring mechanism is in the adjustable state, the tabletop is vertically adjusted relative to the base assembly; and when the air spring mechanism is in the fixed state, the tabletop maintains a fixed height relative to the base assembly.

18. The folding table according to claim 17, wherein the second driving portion is disposed at one side of the tabletop facing the base assembly.

* * * * *